US009002546B2

(12) United States Patent
Whitwam et al.

(10) Patent No.: US 9,002,546 B2
(45) Date of Patent: Apr. 7, 2015

(54) CONTROL OF AUTOMATIC GUIDED VEHICLES WITHOUT WAYSIDE INTERLOCKING

(75) Inventors: Firth Whitwam, Toronto (CA); Abe Kanner, Mississauga (CA)

(73) Assignee: Thales Canada Inc., Toronto, ON (CA)

( * ) Notice: Subject to any disclaimer, the term of this patent is extended or adjusted under 35 U.S.C. 154(b) by 104 days.

(21) Appl. No.: 13/494,566

(22) Filed: Jun. 12, 2012

(65) Prior Publication Data

US 2012/0323411 A1 Dec. 20, 2012

Related U.S. Application Data

(60) Provisional application No. 61/496,626, filed on Jun. 14, 2011.

(51) Int. Cl.

| | |
|---|---|
| ***B61L 23/00*** | (2006.01) |
| ***B61L 23/34*** | (2006.01) |
| ***B61L 21/10*** | (2006.01) |
| ***B61L 27/04*** | (2006.01) |

(52) U.S. Cl.

CPC ..... *B61L 23/34* (2013.01); *B61L 23/00* (2013.01); *B61L 21/10* (2013.01); *B61L 27/04* (2013.01)

(58) Field of Classification Search

CPC ..... B61L 23/00

See application file for complete search history.

(56) References Cited

U.S. PATENT DOCUMENTS

| | | | | |
|---|---|---|---|---|
| 5,620,155 | A | 4/1997 | Michalek | |
| 5,950,966 | A * | 9/1999 | Hungate et al. | 246/62 |
| 2006/0074544 | A1 * | 4/2006 | Morariu et al. | 701/117 |
| 2008/0315044 | A1 * | 12/2008 | Stull et al. | 246/5 |

FOREIGN PATENT DOCUMENTS

| | | | |
|---|---|---|---|
| EP | 0958987 | A2 | 11/1999 |
| WO | 03/035427 | A2 | 5/2003 |

* cited by examiner

*Primary Examiner* — John Q Nguyen
*Assistant Examiner* — Michael Kerrigan
(74) *Attorney, Agent, or Firm* — Marks & Clerk

(57) ABSTRACT

A vehicle management system for automatic vehicles running on a guideway independent of wayside signals or interlocking devices includes intelligent on-board controllers on each vehicle for controlling operation of the vehicle. The on-board controllers communicate with each other as well as individual wayside devices and a data storage system to identify available assets needed to move along the guideway and to reserve these assets for their associated vehicle.

38 Claims, 3 Drawing Sheets

CONTROL OF AUTOMATIC GUIDED VEHICLES WITHOUT WAYSIDE INTERLOCKING

CROSS REFERENCE TO RELATED APPLICATION

This application claims the benefit of U.S. provisional application No. 61/496,626, filed Jun. 14, 2011, the contents of which are herein incorporated by reference.

FIELD OF THE INVENTION

This invention relates to the field of transportation, and in particular to a method of controlling driverless guided vehicle movements without the use of an intelligent wayside zone controller. The invention is particularly applicable to trains, but may be used for other forms of guided vehicle.

BACKGROUND OF THE INVENTION

Driverless trains are becoming increasingly common, especially in urban transportation systems. Existing solutions depend on intelligent wayside controllers, such as Zone Controllers or a Vehicle Control Centre to track all trains, set and lock routes, and authorize train movements. Such solutions are described in IEEE 1474, which relates to Communications Based Train Control. An example of such a system is the Seltrac™ system manufactured by Thales.

These devices have an expensive project life cycle, are complex to design, install, certify and maintain, and need to be customized with the rules of the operating railway. Failure of a single wayside control device shuts down all automatic operation within the territory governed by that device, Additionally, these devices require access controlled equipment rooms, and these rooms can be expensive to build for this purpose.

SUMMARY OF THE INVENTION

According to the present invention there is provided a vehicle management system for guided vehicles running on a guideway, comprising intelligent on-board controllers associated with each vehicle for controlling operation of the vehicle and reserving assets required for the vehicle to safely move along the guideway; wayside devices beside the guideway responsive to commands from the intelligent on-board controllers for controlling system infrastructure; and a data storage system for storing system data; and wherein the on-board controllers are configured to continually communicate with on-board controllers on other vehicles in their vicinity to determine the availability of assets needed for their associated vehicle to move along the guideway, and to reserve these assets by communicating with the on-board controllers on other vehicles, the wayside devices and the data storage system.

Such a system avoids the need for a safe movement authorization from a wayside-based vital controller or wayside signaling equipment such as interlockings, zone controllers or vehicle control centres.

The guideway may be train tracks, although it could be other forms of guideway such as rails, concrete viaduct, monorails, or roads with all changes in lane or track limited to fixed locations referred to as "switches".

The on-board controllers are in continual communication with each other over a broadband data communication network, such as Wi-Fi, for example. This means that they can be in continuous communication, or update at frequent intervals, for example, once per second. The continual communication should occur sufficiently frequently for them to maintain situational awareness in real time.

The data storage system can be virtual and can be provided by the on-board controllers on the trains. It can also include a physical component for logging new trains into the system.

Embodiments of the invention provide a method to safely authorize and efficiently control automatic/Driverless train movements without the use of an intelligent wayside 'Zone Controller' or 'Interlocking'.

Embodiments of the invention also provide a resilient, data communication system that allows implementation of virtual local area networks connecting devices on moving trains and trackside devices. This solution extends the use of such data communication in existing CBTC systems to include direct train-to-train communication.

Advantages of the invention include the elimination of the need for an intelligent Zone Controller, Vehicle Control Centre and/or Interlocking devices on the wayside. Complex wayside controllers are replaced with simpler generic, single point of control devices, which allow the minimization of cabling requirements for command and control.

Embodiments of the invention also allow an increase in throughput due to tighter control loop on movement authorization (eliminating the need for a third party (e.g. Zone Controller) to manage conflicts.)

Embodiments of the invention also provide a method of managing communicating between the components of the system to ensure both a guaranteed safe operation and a quick notification of events, which could impact the safety of the system.

The vehicles may also communicate with a trackside controller, such as such as switch machine controller, platform door controller, track access device controller, etc.

According to another aspect of the invention there is provided a method of managing guided vehicles running on a guideway, comprising providing intelligent on-board controllers on each vehicle for controlling operation of the vehicle; providing wayside devices beside the guideway; and providing a data storage system for storing system data; and wherein the on-board controllers are configured to continually communicate with on-board controllers on other vehicles in their vicinity to determine the availability of assets needed for their associated vehicle to move along the guideway, and to reserve these assets by communicating with the on-board controllers on other vehicles, the wayside devices and the data storage system.

According to a still further aspect of the invention an intelligent on-board controller for guided vehicles running on a guideway, which is configured to continually communicate with on-board controllers on other vehicles in their vicinity to determine the availability of assets needed for their associated vehicle to safely move along the guideway, and to reserve these assets by communicating with the on-board controllers on other vehicles, the wayside devices and the data storage system.

BRIEF DESCRIPTION OF THE DRAWINGS

The invention will now be described in more detail, by way of example only, with reference to the accompanying drawings, in which:—

DETAILED DESCRIPTION OF THE INVENTION

Continual direct train-to-train communication is a key aspect of the present invention. This eliminates the need for the standard wayside-based route setting system and allows trains to be aware not only of their own position and performance but that of neighboring trains so that they can more quickly react to changes in conditions ahead, instead of relying on the wayside device to either warn of pending hazard or advise of clear track ahead.

In embodiments of the present invention, wayside devices are simple generic controllers located trackside, which are used to reserve and control devices such as switch machines, platform doors, etc., in response to commands from the on-board controllers.

All intelligence about safe train movement and control is thus located on the train. Each train has a Very intelligent OnBoard Controller (VOBC) configured with the guideway information needed to determine its safe operating environment as a result of communication with other trains' VOBCs in its vicinity and 'dumb', generic wayside devices. This guideway information includes the running topology as a directed graph, the civil data needed to determine safe speed and braking profiles (including grade and curvature). This arrangement eliminates the need for complex, intelligent wayside infrastructure. A suitable hardware platform for the VOBC for implementing the invention is offered by Thales as part of the Seltrac™ signaling system. The wayside infrastructure can be localized to field devices so that a wayside device failure only impacts the area local to that device. The on-board computer system implements and controls the safe operational movement of the train.

System initialization and coordination of conflicting movements are handled by a service called the Data Storage System (DSS), which may be implemented as a Virtual machine comprising the on-board controllers. A physical unit may be installed at a convenient wayside location to enable initial system startup. Once there are trains operating in the system, failure of that device will not impact operations as the services provided are redundantly duplicated in all on-board controllers (VOBC).

Figure 4:
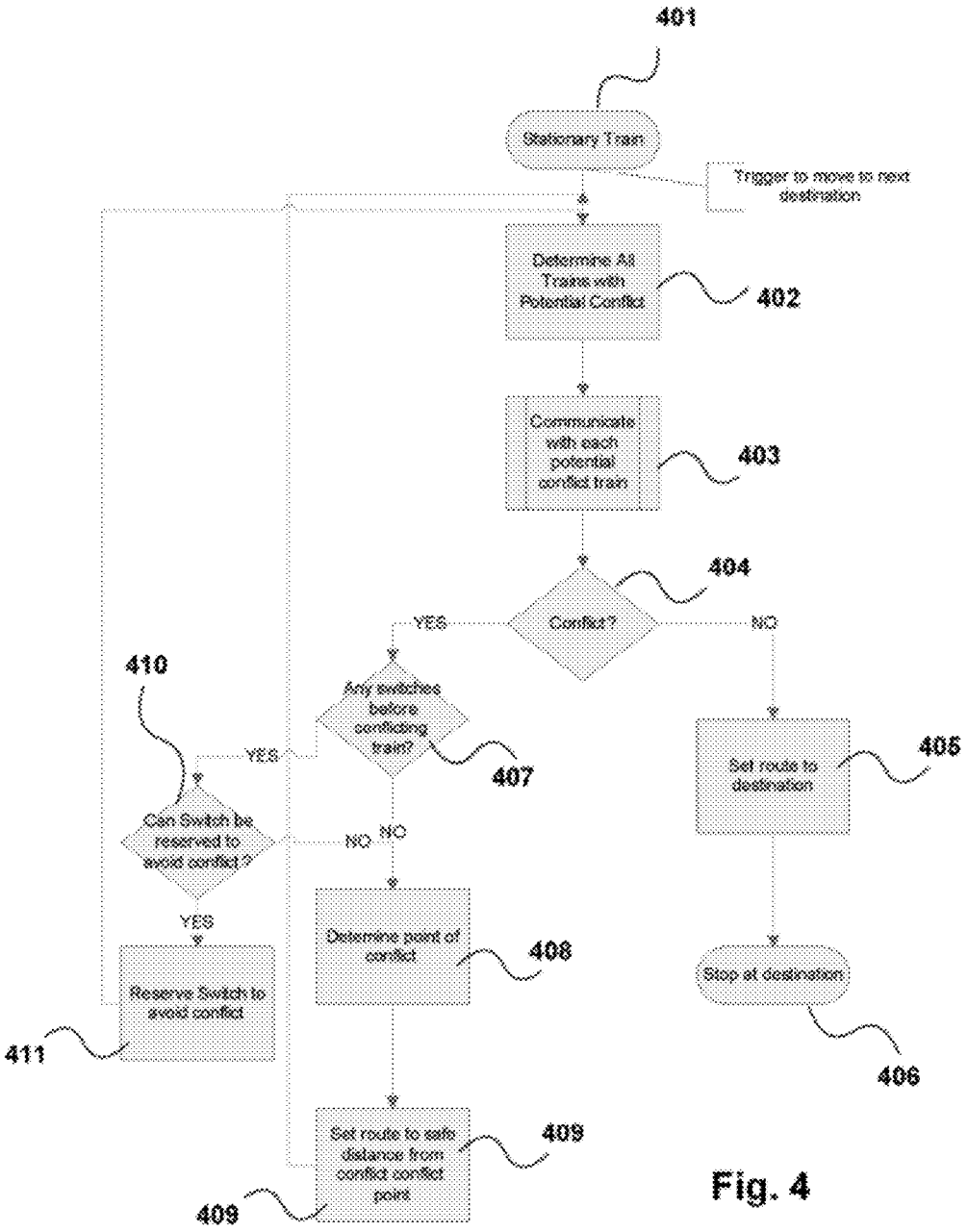
FIG. 4 shows an exemplary algorithm for ensuring safe movement of a train when combined with a vital operating platform such as the Thales 'TAS Platform'.

Each VOBC continually communicates with other VOBCs in the system and generic wayside devices via the communication network. From this communication, each VOBC determines how far it can allow the train to safely travel. Prior to proceeding, the VOBC must 'reserve' this territory with the other VOBCs and wayside devices in its vicinity. The train VOBC must negotiate its movement needs with the other trains VOBC that could be in conflict with its intended movement. It must also ensure that all wayside track devices are set in the proper position and 'locked' to allow safe movement of the train. FIG. 4, which will be discussed in more detail below, shows the algorithm for assuring the safe movement of trains.

In order to ensure that train VOBC knows its environment, it must communicate with all trains' VOBCs in the system. The data communication network is established for this purpose. The data communication network should preferably be broadband, but it is not required to provide data security features.

A dumb virtual 'wayside' system DSS detects new trains and logs them into the system. The DSS also logs all reservations and status of wayside devices. The DSS is also used for configuration management to ensure that all trains' VOBCs are operating with the correct application version and the correct track databases. It also registers all temporary changes in operating conditions such as Go Slow Zones, Closed Stations and Closed Tracks. The DSS also acts as a clearing house to log all reservations and status of wayside devices.

A Virtual Data Storage System keeps track of all trains in the system and all system operating parameters and topology. A dedicated machine may be installed to enable system initialization but once VOBCs have entered into the System, the DSS system is distributed in such a way that any of the VOBCs can also supply the services of the physical DSS.

Each VOBC is based on a vital (Cenelec SIL4) operating platform such as the VOBC offered as part of the Seltrac™ system. The Virtual Data Storage System is implemented by running a background process on every vital machine (SIL 4) in the system which listens to communication traffic and collects key data as identified by the configuration profile. Each vital machine is provided with a priority sequence number at start up from the vehicle supervision system. Based on the priority sequence number, the primary DSS server is allocated as well as a secondary DSS server. Both of these servers will share data with the active vehicle management system processes as required. If the primary server fails, the secondary server will become primary and activate the next priority machine as secondary. If the secondary machine fails, the primary server will activate the next secondary server. In the rare event that both servers fail before a new server can be activated, the background process will re-initialize a new primary and secondary server based on the negotiated priority sequence numbers.

The Communication system permits each device to communicate with every other device in the system.

Figure 3:
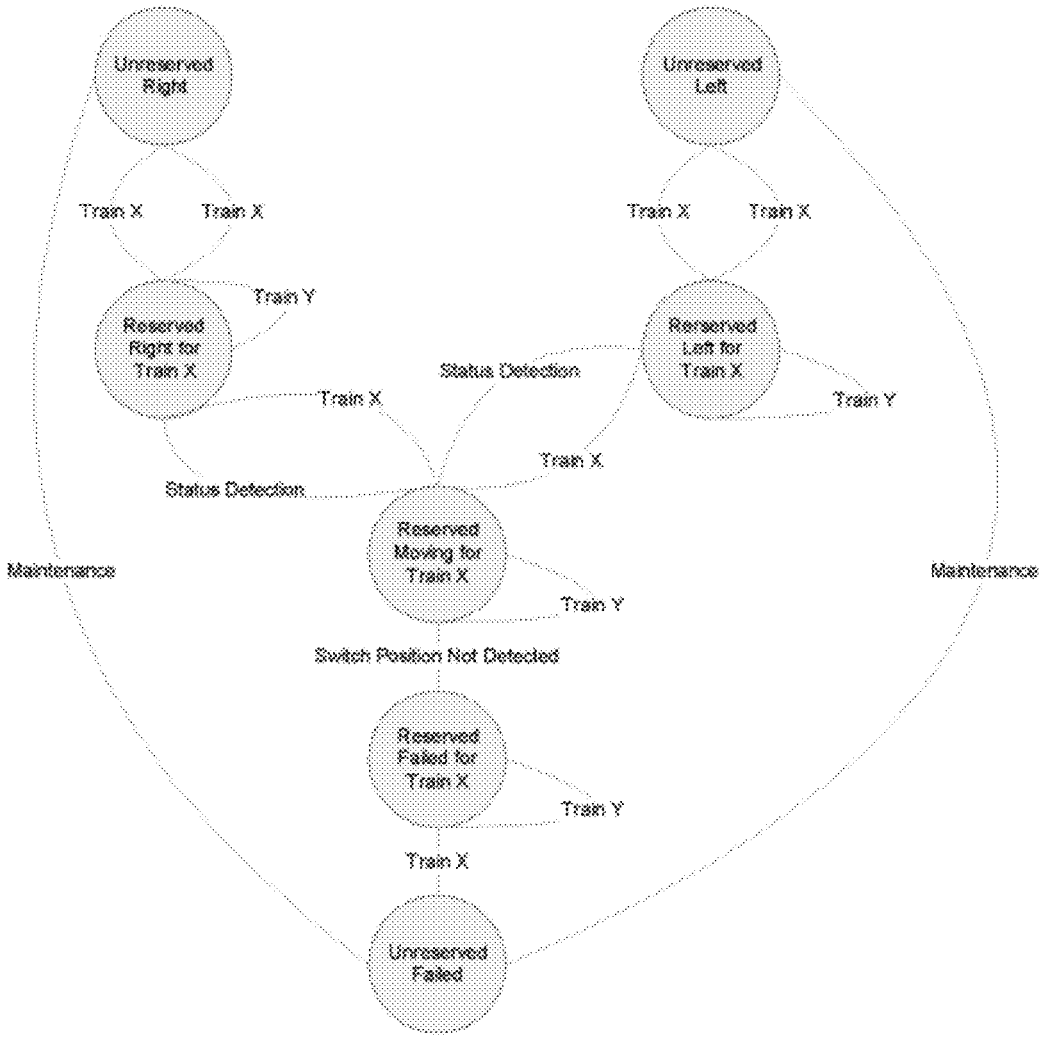
FIG. 3 is a state machine representing the switch control function of a wayside device.

For example, direct communication takes place between vehicles' VOBCs and switch controllers, to reserve move, and lock the switch in the desired position. The switch will only be 'unreserved' and made available for another train when the reserving train VOBC has authorized the release. FIG. 3, described in more detail below, shows the simple state machine used to ensure only one train can control a switch at anytime. The switch does not respond to commands from train Y while it is reserved for train X.

Figure 1:
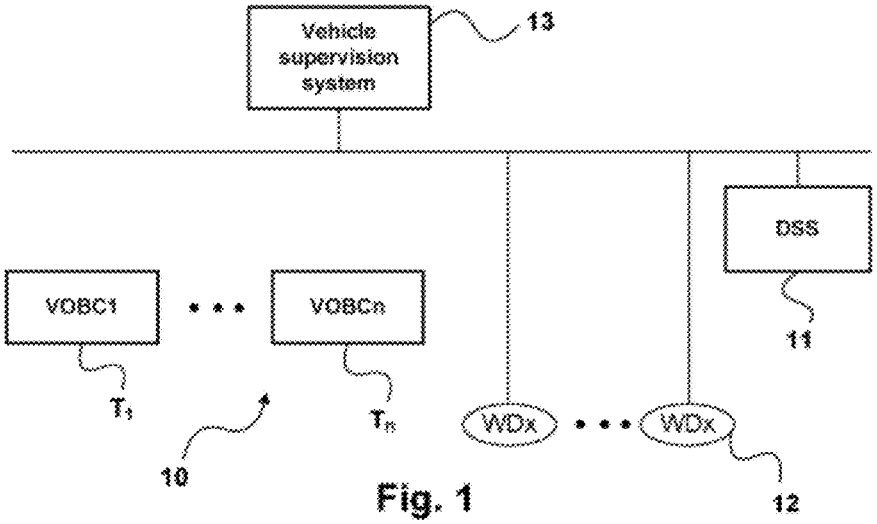
FIG. 1 shows a layout of a system in accordance with one embodiment of the invention.

Referring now to FIG. 1, each train 10, designated $T_1 \ldots T_n$, contains a very intelligent on board controller $VOBC_1 \ldots VOBC_n$. Each VOBC is based on a vital (Cenelec SIL4) operating platform such as the VOBC offered as part of the Seltrac™ system. These controllers control train motion based on limit of movement authority derived from wayside devices status and reservations from other VOBCs. The VOBC communicates with other trains' VOBC's in the system, the DSS, and wayside devices 12 designated $WD_x \ldots WD_z$ in FIG. 1.

The vehicle supervision system 13 provides for the man machine interface to control the operation of the system. The vehicle supervision system 13 communicates with wayside device 12, the DSS 11 and the VOBCs on the trains 10. The vehicle supervision system 13 also determines the service requirements for each train 10.

The data storage system, DSS 11, is the depository for the system data including topography, wayside device status and reservation vehicle position, temporary speed restrictions, closed stations, and closed tracks.

The DSS 11 communicates with the vehicle supervision system 13, wayside devices 12, and the VOBCs, and is used to 'protect' entry into the system by unauthorized/un-protected trains. The DSS 11 is implemented as a 'cloud' service. A single device provides for normal and startup operations, but in case of failure the service can be provided by any other VOBC on-Board unit in the system.

The wayside devices 12 are single point of control devices (redundant or non redundant) that control a guideway asset e.g. switches, passenger emergency stop buttons, platform door controller etc. Each wayside device 12 communicates continuously with the DSS 11 and the trains' VOBC's 10 when polled. In addition, if there is an uncommand change in state to a 'reserved' device, the wayside device will push an alarm to the reserving train allowing for a minimal response time to crisis events.

In order to assure diversity in the execution of control in the system, the system provides a diverse path for the control and reservation of wayside devices 12. This assures that the safety of the system is maintained in the event of wayside devices and communication failure.

The diverse control path operates on the principle that any request for a more permissive move must be confirmed via a diverse path between the trains VOBC, the wayside device, other train VOBC's, and the DSS (11). This is achieved by the wayside device 12 logging and confirming the clearance request first with the DSS 11 and then confirming the clearance with the Train VOBC. The train VOBC from its side independently verifies the clearance with the wayside device 12 and the DSS 11 in order to assure that clearance request is persistent from two independent sources (wayside device and DSS).

If the device is already reserved the train VOBC need only to communicate with the wayside device 12 to confirm that the device is already reserved.

Once the train VOBC has consumed its reservation the train VOBC releases the reservation independently to the DSS 11 and the wayside device 12. The wayside device does not clear the reservation until confirmed by the DSS that the reservation is clear via the persistent diverse path.

The trains' VOBC also communicate their location and other status of the train subsystems to the DSS 11 on a cyclic basis via communication network. The DSS 11 updates the train position once the position of the train is consistently received and reports it to the vehicle supervision system 13.

wayside devices 12 that only provide status (axle counters, track circuits passenger emergency stop buttons etc.) communicate their status to the DSS 11 on a cyclic basis and when interrogated (via the communication network) by a train VOBC.

In an exemplary embodiment, the system operates as follows:

On entry to the system from dark territory not covered by the system, a particular train's VOBC communicates with the DSS 11 to obtain a status of all the trains in the system (location travel direction etc.). From the received status the train VOBC determines special locations where it may interact with its immediate neighbors.

In addition the train's VOBC obtains the reservation status for wayside devices in its immediate surroundings and the status of the guideway, for example, temporary speed restriction, closed track etc.

The train VOBC obtains its destination from commands from the vehicle supervision system 13 and uses the information to command and control its movements along the guideway.

The detailed algorithm is shown in FIG. 4. At the start 401 a train is stationary. On a trigger event to move to the next destination a determination is made at step 402 of all trains in conflict. Communication is effected with each train in potential conflict at step 403. A step 404 a determination is made as to whether an actual conflict exists. If not the route is set to the destination at step 405 to permit the train to proceed to the destination 406.

If a conflict exists a determination is made at step 407 whether there are any switches before the conflicting train 407. If not a determination is made as to the point of conflict and the route set to the point of conflict 409.

If there is a switch before the potentially conflicting train, a determination is made as to whether the switch can be reserved to avoid the conflict 410. If yes the switch is reserved to avoid the conflict at step 411.

A typical timing sequence for the safe clearing of reservations for a device using a diverse path is as follows:

At time T0, Switch X is reserved for Vehicle A.

At time T1, Vehicle A determines that Switch X reservation is no longer required to ensure safe operation.

At time T2, Vehicle A sends message to WD for Switch X to clear reservation.

At time T3, Vehicle A sends message to DSS that Reservation of Switch X is no longer required.

At time T4, Data Storage Systems sends message to WD for that Train X does not require reservation of Switch X.

At time T0, WD has consistent information that Vehicle A does not require reservation of switch X so reservation is released.

Various functions need to be performed by the VOBCs as follows:

Determination of Limit of Authority

The VOBC on a train communicates with the other trains' VOBCs in its vicinity to obtain the reservation associated with each of the other trains.

By determining its commanded destination the VOBC determines the sections of track it will need to get permission to enter and occupy. If none of the required tracks are occupied or reserved by another VOBC or the DSS, the VOBC reserves the tracks with the DSS and other trains VOBC's and all wayside devices along the section. In parallel the wayside devices 12 then register their reservation status with the DSS 11 prior to communicating the information to the reserving train VOBCs. Once the reservations have been confirmed the train VOBC advances its limit of authority into the reserved direction.

As the train traverses the section it releases the reservation to the DSS 11, the wayside devices 12 and the other trains VOBCs. This process repeats itself until the train arrives at its destination. As the train VOBC continuously communicates with other trains' VBOCs, the wayside devices 12 and the DSS 11, should an abnormal event occur that may impact or violate the train's safety operating envelope or the reservation (switch becoming out of correspondence), the VOBC pulls back its limit of authority and if necessary operates the Emergency Brake.

Reservation of Wayside Device

The train VOBC identifies the wayside device that is required to be reserved in a particular state to enable the train to continue safely on its intended journey.

The VOBC receives confirmation from DSS 11 that a particular wayside device is reserved for the train's use. (If not, the VOBC(1) will ensure the train stops safely in front of the device).

The train VOBC receives confirmation from the wayside device that it is locked in correct state and reserved for it.

The train VOBC advances its limit of authority.

When the rear of train has cleared the device, the VOBC sends a release message to the wayside device and the DSS.

Reservation of Open Tracks

The train's VOBC identifies the area of track that is required for the next leg of its assignment and requests a reservation of that area from the DSS 11.

The DSS 11 identifies to the requesting train VOBC all VOBCs that also require part of that section of track.

The train VOBC receives information from the other VOBCs regarding the state of their reservation and sets its limit of authority based on the area it is able to safely reserve after confirmation with the DSS.

VOBC Communications

The train VOBC maintains continuous communication with the DSS 11 over the communications network. The train VOBC communicates with each train VOBC in its vicinity ('connected' trains if the railway network is treated as a graph) once per second.

Figure 2:
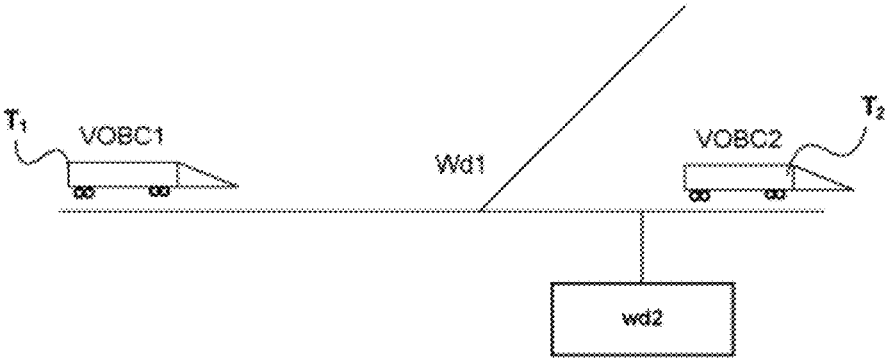
FIG. 2 shows an exemplary train configuration.

The train VOBC communicates with all other trains VOBCs in the system cyclically to monitor health of the system In the example shown in FIG. 2, VOBC1 must reserve and lock the switch wd1 in the correct position by communicating with wd1, it must ensure the platform doors in the station are locked closed by communicating with wd2, and it must ensure the proceeding train with VOBC2 has moved sufficiently out of the platform and unreserved the area to allow safe ingress before it can extend its movement authority into the station area and dock the train.

Once docked, VOBC1 communicates with WD2 to synchronize the opening of the train and platform doors.

Handling of Conflicting Reservation Requests

In general, the vehicle supervision system pre-sets reservations for trains based on the operational priorities of the schedule so that, when a train requests a reservation, it is either 'pre-approved' or rejected due to an existing conflict.

In the event of failure of the vehicle supervision system, it is possible that a race condition may be created between conflicted routes and the system reacts safely. In this case, the DSS 11 allocates the reservation to the track or device on a first-come-first-served basis.

Handling of On-Board Failures

There are two classes of failure of on-board equipment: failures that prevent communication and failures that prevent continued safe operation of the train. It should be noted that the train installation would normally include fully redundant controllers and redundant radios so that failure of a single component should not result in loss of control or communication capability.

Failures that prevent continued safe operation of the train by the train VOBC will cause the train to come to a stop on the track and will require manual intervention to safely move the train to a location where it can either be repaired or removed from service. To enable this movement with minimal impact to the rest of the system, the vehicle supervision system 13 can reserve the track and devices for the required train movement and release the route once the train has been taken out of service via the DSS 11.

Failures that prevent communication will also result in the train coming to a stop at the limit of its previously authorized movement authority. If communication cannot be reestablished, it will be necessary to manually move the train using the ATS to set and reserve the route for the train via the DSS 11.

A train may use its 'safe braking model' algorithms, as already implemented in existing SelTrac solutions, to determine if it can safely extend its existing train movement without infringing on another train movement. This includes both the normal, expected train braking profile and the emergency braking profile associated with the vehicle failures that impact normal train movement such as propulsion failure, common mode brake failures, and power failures, Embodiments of the invention thus permit a vital wayside control device with no knowledge of the train control or route locking requirements of the system to be used to ensure safe movement of trains across and in the vicinity of the controlled device.

The trains preferably employ a data communication system that allows high quality train to train communication and train to track device communication to connect safe operating platforms (hardware and operating system) on board moving vehicles constrained in movement by fixed guideways such as rails, concrete viaduct, monorail, or road with all changes in lane or track limited to fixed locations called 'switches'. However, it is not required to provide security or safety functionality.

The bandwidth requirements of the data communication system used to implement a communication-based train control system can be minimized while providing the necessary, real time data to each vehicle to ensure safe operation.

The vital computer platform may be used to provide system initialization data. This then becomes part of the Data Storage System co-located on intelligent vital devices throughout the system to ensure operational availability of the ability to move vehicles even in the event of multiple failures.

The invention claimed is:

1. A vehicle management system for guided vehicles running on a guideway, comprising:

a) intelligent on-board controllers associated with each vehicle for controlling operation of the vehicle and negotiating movement needs of the vehicle with other vehicles in potential conflict;

b) stationary wayside devices located beside the guideway directly responsive to commands from the intelligent on-board controllers to control guideway assets facilitating safe movement of the vehicle along the guideway along a desired route and associated with the wayside devices and required for the vehicles to move along the guideway, said wayside devices having a reserved and unreserved state, wherein in the reserved state the wayside devices and guideway assets associated therewith are reserved exclusively for use by a particular vehicle and respond only to commands from the particular vehicle, and wherein in the unreserved state said wayside devices are available for reservation by other vehicles running on the guideway;

c) a data storage system for storing system data including the reserved and unreserved state of said wayside devices;

wherein the intelligent on-board controllers are configured to:

i) continually communicate with on-board controllers on other vehicles in their vicinity to determine the availability of guideway assets needed for their associated vehicle to move along a section of the guideway, ii) to reserve the wayside devices associated with the needed assets for the exclusive use of their associated vehicle by communicating with the on-board controllers on other vehicles, the wayside devices and the data storage system, and iii) to release the reserved wayside devices into the unreserved state for use by other vehicles when no longer required by their associated vehicle.

2. A vehicle management system as claimed in claim 1, wherein the on-board controllers are configured to negotiate and resolve potential safe movement conflicts with on-board controllers on other vehicles independently of the wayside controllers.

3. A vehicle management system as claimed in claim 2, wherein the data storage system comprises a distributed virtual storage implemented by the on-board controllers such that any failure of wayside equipment will not prevent the system from continuing to safely move vehicles in the system configuration in place at the time of failure.

4. A vehicle management system as claimed in claim 3, wherein the data storage system includes a physical data storage system for logging new trains into the management system and managing system configuration.

5. A vehicle management system as claimed in claim 1, wherein the wayside devices provide device control and status but no movement authority or interlocking logic.

6. A vehicle management system as claimed in claim 1, wherein the on-board controllers are configured, upon clearing a reserved section of guideway, to send a clearance request message to other on-board controllers, a proximate wayside device and the data storage system to free the reserved section for use by other vehicles.

7. A vehicle management system as claimed in claim 6, wherein the on-board controllers are configured to identify the next section of guideway required for the next leg of an assignment, and in response information relating to the reservations made by other on-board controllers set the limit of authority based on the section they can safely reserve taking into account reservations of other vehicles.

8. A vehicle management system as claimed in claim 1, wherein at least some of the wayside devices are configurable to detect new trains and log them into the data storage system.

9. A vehicle management system as claimed in claim 8, wherein the on-board controllers are configured, upon entry in to the system, to obtain the status of other vehicles on the system from the data storage system.

10. A vehicle management system as claimed in claim 9, wherein the on-board controllers are configured, upon entry into the system, to obtain the reservation status of wayside devices in its vicinity.

11. A vehicle management system as claimed in claim 10, wherein the on-board controllers are responsive to commands from a vehicle supervision system to obtain destination information, and wherein the on-board controllers are configured to use the destination information to determine which sections of guideway they will need to reserve to enable a vehicle to reach the destination.

12. A vehicle management system as claimed in claim 11, wherein the vehicle supervision system is configured to pre-approve reservations based on operational priorities such that when a vehicle requests a reservation from the system it is either accepted based on a prior approval or rejected due to another vehicle having a higher priority.

13. A vehicle management system as claimed in claim 1, wherein some of the wayside devices control operation of the guideway and when reserved for a particular vehicle are responsive to commands from the on-board controller of that vehicle to set their operating state.

14. A vehicle management system as claimed in claim 13, wherein said wayside devices include switch controllers and platform door controllers.

15. A vehicle management system as claimed in claim 1, wherein each intelligent on-board controller is configured to communicate its status and location at intervals to the data storage system.

16. A vehicle management system as claimed in claim 1, wherein when a vehicle reaches its limit of authority on a protected section without authority to enter the next section, the on-board controller is configured to stop the vehicle prior to leaving the protected section.

17. A vehicle management system as in claim 1, wherein in response to a failure condition, the on-board controllers are configured to stop the vehicle on a protected section of guideway pending further intervention of the system.

18. A vehicle management system as claimed in claim 1, wherein the wayside devices are configured to communicate their status to the on-board controllers in response to interrogation requests therefrom.

19. A vehicle management system as claimed in claim 1, wherein the intelligent on-hoard controllers are further configured such that when the guideway asset associated with a particular wayside device is no longer required by a said vehicle, the intelligent on-board controller associated with that vehicle sends a clearance request message to that particular wayside device and the data storage system via diverse paths; and wherein the wayside devices are further configured such that in response to a clearance request message from an intelligent on-board controller they clear the reservation upon receipt of a consistent message from said data storage system.

20. A method of managing guided vehicles running on a guideway, comprising:

operating intelligent on-board controllers on each vehicle to control operation of the vehicle and negotiate movement needs of the vehicle with other vehicles in potential conflict;

stationary wayside devices located beside the guideway directly responding to commands from the intelligent on-board controllers to control guideway assets facilitating safe movement of the vehicle along the guideway along a desired route and associated with the wayside devices and required for the vehicles to move along the guideway, said wayside devices having a reserved and unreserved state, wherein in the reserved state the wayside devices and guideway assets associated therewith are reserved exclusively for use by a particular vehicle and respond only to commands from the particular vehicle, and wherein in the unreserved state said wayside devices are available for reservation by other vehicles running on the guideway operating a data storage system to store system data including the reserved and unreserved state of said wayside devices; and the intelligent on-board controllers:

a) continually communicating with on-board controllers on other vehicles in their vicinity to determine the availability of guideway assets needed for their associated vehicle to move along a section of the guideway, b) communicating with the on-board controllers on other vehicles, the wayside devices and the data storage system to reserve the wayside devices associated with the needed assets for the exclusive use of their associated vehicle, and c) releasing the reserved wayside devices into the unreserved state for use by other vehicles when no longer required by their associated vehicle.

21. A method as claimed in claim 20, wherein the on-board controllers negotiate and resolve potential conflicts with on-board controllers on other trains.

22. A method as claimed in claim 21, wherein the on-board controllers send a clearance release message to a proximate wayside device and the data storage system upon clearing a reserved section of guideway to make the reserved section available for use by another vehicle.

23. A method as claimed in claim 22, wherein the intelligent on-board controllers identify the next section of guideway required for the next leg of an assignment, and in response to information relating to the reservations made by other intelligent on-board controllers set the limit of authority based on the section they can safely reserve taking into account reservations of other vehicles, and wayside devices.

24. A method as claimed in claim 20, wherein at least some of the wayside devices detect new trains and log them into the data storage system.

25. A method as claimed in claim 24, wherein the on-board controllers obtain the status of other vehicles on the system from the data storage system upon entry in to the system.

26. A method as claimed in claim 25, wherein the on-board controllers obtain the reservation status of wayside devices in their vicinity upon entry into the system.

27. A method as claimed in claim 26, wherein the on-board controllers respond to commands from a vehicle supervision system to obtain destination information, and wherein the on-board controllers use the destination information to determine which sections of guideway they will need to reserve to enable the vehicle to proceed to the destination.

28. A method as claimed in claim 27, wherein the vehicle supervision system pre-approves reservations based on operational priorities, such that when a vehicle requests a reservation from the system the reservation is either accepted based on a prior approval or rejected due to another vehicle having a higher priority.

29. A method as claimed in claim 20, wherein the wayside devices control operation of the guideway assets and when reserved for a particular vehicle are responsive to commands from the on-board controller of that vehicle to set the operating state of the equipment they control.

30. A method as claimed in claim 20, wherein each on-board controller communicates its status arid location at intervals to the data storage system.

31. A method as claimed in claim 20, wherein when a vehicle reaches its limit of authority on a protected section without authority to enter the next section, the intelligent on-board controller on that vehicle stops the vehicle prior to leaving the protected section.

32. A method as claimed in claim 20, wherein the wayside devices communicate their status to the data storage system on a cyclic basis.

33. A method as claimed in claim 32, wherein the wayside devices communicate their status to the intelligent on-board controllers in response to interrogation requests therefrom.

34. A method as claimed in claim 20, wherein necessary data about guideway conditions and other vehicle locations and authorized movements are maintained in an on-board vehicle database, and safe movement algorithms are executed on an on-board computer to safely authorize the movement of vehicles without the use of guideway-side signaling equipment.

35. A method as claimed in claim 34, wherein an intelligent on-board controller associated with a vehicle keeps track of the position of all vehicles in the system and communicates with those vehicles to monitor changes in position and determine which vehicles, if any, could potentially be in a conflict with a movement plan of the vehicle.

36. A method as claimed in claim 35, wherein an intelligent on-board controller associated with a vehicle communicates with a wayside device to command the wayside device to change its state to 'reserved' so that no other vehicle can affect the state of the device, and once reserved for a particular vehicle, the wayside device can be commanded by that particular vehicle to control the guideway asset associated therewith.

37. A method as claimed in claim 35, wherein an intelligent on-board controller negotiates with the intelligent on-board controllers of its immediate 'neighbour' vehicles to ensure that a safe traversal of the guideway without conflict can be assured.

38. A method as claimed in claim 20, wherein when the guideway asset associated with a particular wayside device is no longer required by a said vehicle, the intelligent on-board controller associated with that vehicle sends a clearance message to that particular wayside device and the data storage system via diverse paths; and wherein in response to a request to clear a reservation from a said intelligent on-board controller the wayside devices clear a reservation upon receipt of a consistent message from said data storage system.

* * * * *